US006328466B1

(12) United States Patent
Kadota et al.

(10) Patent No.: US 6,328,466 B1
(45) **Date of Patent: *Dec. 11, 2001**

(54) AGITATION BLADE

(75) Inventors: Naohiro Kadota; Yoshitaka Teratani; Hisao Ito, all of Kawasaki; Jun Ikeda, Saga-ken, all of (JP)

(73) Assignee: Ajinomoto Co., Inc., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/341,675

(22) PCT Filed: Jan. 14, 1998

(86) PCT No.: PCT/JP99/00106

§ 371 Date: Aug. 31, 1999

§ 102(e) Date: Aug. 31, 1999

(87) PCT Pub. No.: WO98/31456

PCT Pub. Date: Jul. 23, 1998

(30) Foreign Application Priority Data

Jan. 20, 1997 (JP) ..... 9-008010

(51) Int. Cl.[7] ..... B01F 7/00

(52) U.S. Cl. ..... 366/317; 261/93; 366/263; 366/329.1

(58) Field of Search ..... 366/102, 105, 366/325.1, 329.1, 343, 263, 264, 265, 103, 104, 315, 316, 317; 261/87, 93

(56) References Cited

U.S. PATENT DOCUMENTS 4,967,968 * 11/1990 Vitelli ..... 241/46.17
5,366,698 * 11/1994 Smith et al. ..... 422/168
5,538,630 * 7/1996 Burns .
5,785,424 * 7/1998 Noda et al. .
5,791,780 * 8/1998 Bakker ..... 261/93
5,904,423 * 5/1999 Forschner et al. ..... 261/93

FOREIGN PATENT DOCUMENTS 51-031170 * 3/1976 (JP) .
51-033505 * 9/1976 (JP) .
05-154368 * 9/1993 (JP) .
09-271650 * 10/1997 (JP) .

* cited by examiner

*Primary Examiner*—Joseph W. Drodge
(74) *Attorney, Agent, or Firm*—Oblon, Spivak, McClelland, Maier & Neustadt, P.C.

(57) ABSTRACT

A stirring blade unit includes a perforated cylinder formed around the an internal stirring blade so as to be rotated together with the stirring shaft. The perforated cylinder has perforations which are approximately 30 to 50% of the area of the top and bottom surface of the perforated cylinder. The internal stirring blade unit uses a discharge type stirring blade unit used for gas-liquid mixing of a general fermentation tank. Thus, the gas-liquid flow discharged from the blade unit in the horizontal direction hits the perforated cylinder formed around the blade unit certainly. Due to this hitting of the gas-liquid flow against the perforated cylinder, the pressure of the flow is changed significantly to refine the gas bubbles so that the gas absorption property is improved. The stirring blade unit is suitable for gas-liquid mixing necessary for such as, fermentation, aeration, and reaction (hydrogenation and oxidation) tanks. The gas-liquid mixing blade unit can absorbs gas efficiently and thus, reduces both the manufacturing cost and installation space.

8 Claims, 2 Drawing Sheets

AGITATION BLADE

This application is a 371 of PCT/JP98/00106, filed on Jan. 14, 1998.

FIELD OF THE INVENTION

The present invention relates to stirring blade units, more particularly to a stirring blade unit that, used in a gas-liquid mixing tank, refines and disperses a gas supplied from a nozzle or a sparger provided just under said blade unit into a liquid to absorb said gas at a low cost, in a compact space, and at a high efficiency.

BACKGROUND OF THE INVENTION

Gas-liquid mixing is adopted in various processes, typically in fermentation, waste water treatment, oxidation, hydrogenation, etc. Among those processes, aeration stirring can satisfy the required volume of oxygen for culturing in an aerobic fermentation process due to the aeration and stirring functions, but actually, in many cases of gas-liquid mixing, the productivity is decided by the oxygen supply capacity of the fermentation tank in use. The main object of the gas-liquid mixing will be to refine and disperse bubbles and absorb gas components into a liquid. As for gas absorption in a gas-liquid contact maker using a stirring tank, a well known relational expression (see Industrial Engineering Chemistry, volume 45, page 2554–2560 (1944)) is, as follows:

$$Kla\ Pv^{\alpha} \times Us^{\beta},$$

wherein

KL is the mass transfer coefficient of liquid stirring;

a is the gas-liquid interface are per unit volume;

Pv is the stirring power per unit volume;

Us is the superficial gas velocity; and $\alpha$, $\beta$ are constants.

In order to improve the efficiency of gas absorption, a problem of how to increase the gas-liquid interface area a, that is, how to minimize bubbles in size and disperse them, must be solved. Because, the KL in the above expression is decided by the solid state properties and fluid state of the material. Actually, however, the stirring power Pv and aeration capacity Us are increased to solve the problem.

In addition, in order to achieve the above object, measures had to be taken to refine bubbles efficiently while both stirring power and aeration capacity were suppressed from increasing as much as possible, as well as a more effective stirring blade unit had to be developed. And, in recent years, there are introduced a blade unit that can mix gas and liquid efficiently without damaging the microorganisms (Unexamined Published Japanese Patent Application No. 5-103956), a fermentation tank improving method that can improve the ferment shift capacity coefficient (KLa) by fixing a wire mesh in the target fermentation tank so as to surround the stirring blade unit(Examined Published Japanese Patent Application No. 3-4196), an effective method of mixing and gas-liquid contact by providing a gas inlet at the tip of the stirring blade unit (Examined Published Japanese Patent Application No. 57-60892), a stirring blade unit that can improve the stirring mixture effectively using a stirring blade unit that can rotate a pair of propellers and a perforated cylinder together (Unexamined Published Japanese Patent Application No. 6-85862), etc. and their effects are already confirmed.

Actually, however, it will be difficult to improve gas absorption by increasing the above stirring power and aeration capacity. Because the increase of those items is accompanied by expansion of the equipment and increasing of energy. When increasing the stirring power, measures such as increasing the rotation speed of stirring and increasing the blade size are thought of, but those measures will require improvement and reinforcement of some components related to the stirring, such as modification of the agitator itself, increasing of the strength of the stirring tank, etc. Especially, it will be difficult to apply such the improvement and reinforcement as mentioned above to existing equipment for the reasons of construction method and cost in many cases.

Furthermore, when operating any of those developed in recent years in an industrial scale, it will arise problems that the rotation speed must be more increased to obtain the expected effect, the equipment will become more complicated in structure, and the equipment will be more expanded in size (so that it cannot be fixed in the target stirring tank), etc. When the power characteristics of the blade unit differ from those of the conventional blade unit such as turbine blades, etc., the blades will be more expanded in size. In such a case, therefore, it will be difficult to apply the blade unit to any of existing stirring equipment.

DISCLOSURE OF THE INVENTION

Under such the circumstances, it is an object of the present invention to solve the above prior art problems and provide a compact stirring blade unit that can absorb a gas more efficiently and be used in a gas-liquid mixing tank.

In order to achieve the above object, the present invention provides a discharge type stirring blade unit, in which a perforated cylinder is formed around the stirring blade unit so as to be rotated together with the shaft of the stirring blade unit. The numerical aperture of the perforated cylinder rotated together with the shaft in the present invention should be 30 to 50%.

BEST MODE FOR CARRYING OUT THE INVENTION

Hereunder, the examples of the present invention will be described with reference to the attached drawings.

Figure 1A:
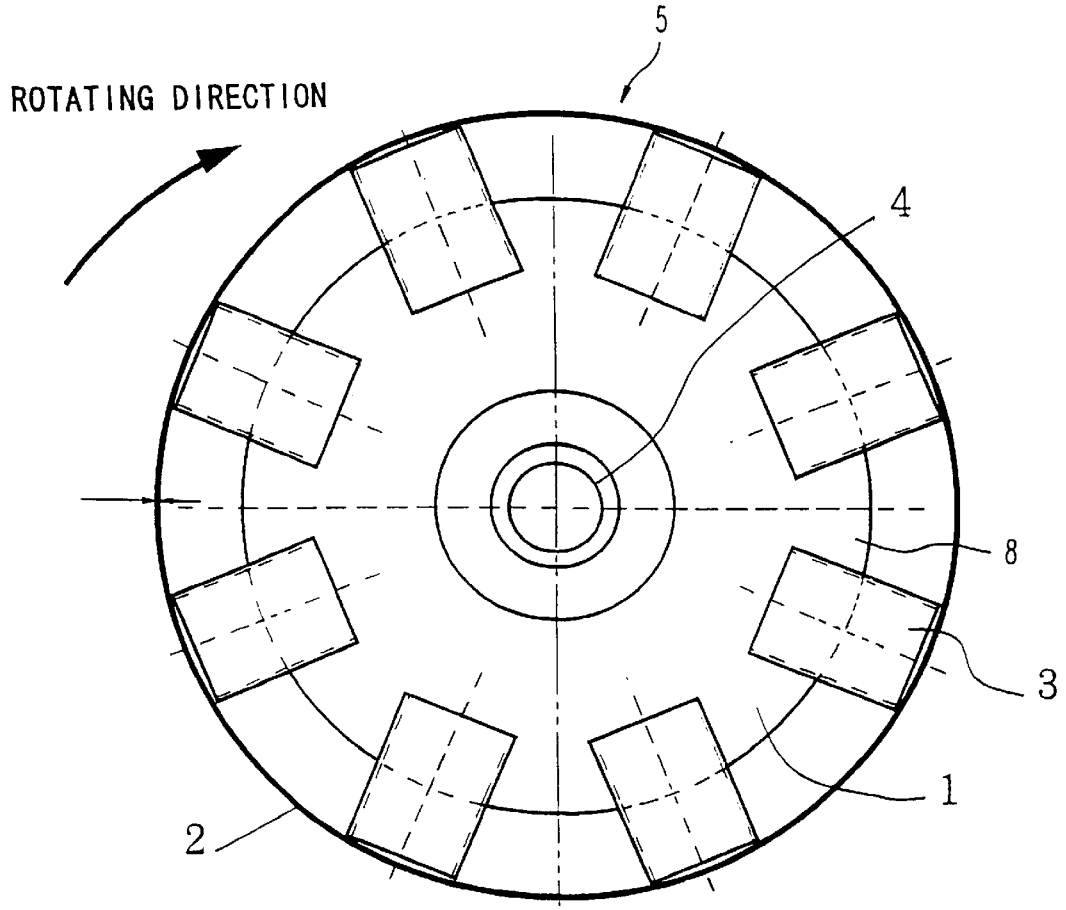
FIGS. 1*a* and 1*b* are a top plan view and side elevational view, respectively, of the entire stirring blade unit 5 of the present invention (when a cylindrical blade unit is used as the internal stirring blade unit), wherein the side elevational view has portions of the outer perforated cylinder 2 removed for clarity of view of the internal stirring blade unit 1.
Figure 1B:
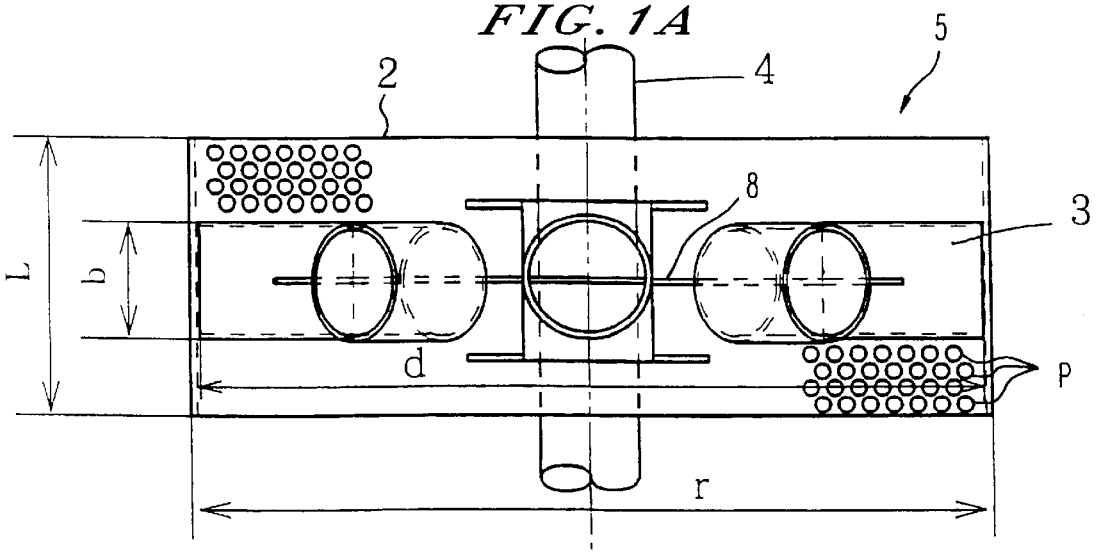

FIGS. 1(*a*) and 1(*b*) are a top plan view and a front view, respectively, of the entire stirring blade unit 5 in an example of the present invention. The basic structure of the entire stirring blade unit 5 of the present invention is characterized by a perforated cylinder 2 formed around a discharge type internal stirring blade unit 1 provided with a disc 8 preventing bubbles from going up, i.e., the internal stirring blade unit 1 being defined as being made up of the disc 8 and the blades 3, while the entire stirring blade unit 5 includes the perforated cylinder 2, the shaft 4, and the internal stirring blade unit 1. The perforated cylinder 2 is rotated together with the shaft 4 of the internal stirring blade unit 1. In FIGS. 1(*a*) and 1(*b*), the internal stirring blade unit 1 is formed as a cylinder blade unit having cylindrically-shaped blades 3. The internal stirring blade unit 1 is generally a discharge type stirring blade unit and is used for gas-liquid mixing for a fermentation tank, etc. The entire stirring blade unit 5 is structured so that the gas-liquid flow, discharged by the internal stirring blade unit 1 in the horizontal direction, hits the perforated cylinder 2 formed around the internal stirring blade unit 1 certainly. When a discharge type stirring blade unit is used as the internal stirring blade unit 1, the gas-liquid flow discharged from the internal stirring blade unit 1 can hit the perforated cylinder 2 vertically to change the pressure of the flow significantly. In the present invention, therefore, a discharge type stirring blade unit is used. It is not an axial flow type one. Because of the pressure change caused when the gas-liquid flow hits the perforated cylinder 2, gas bubbles are refined and absorbed more rapidly. In addition, since the perforated cylinder 2 is rotated together with the shaft, the perforated cylinder 2 can be formed very closely at the tip of the internal stirring blade unit 1 where the discharged gas flows most strongly to obtain the maximum pressure change. If the perforated cylinder 2 is fixed in the stirring tank 9, a clearance must be formed between the internal stirring blade unit 1 and the perforated cylinder 2 in order to prevent impact between them. Thus, the maximum pressure change will not be obtained and the efficiency of the gas absorption will be lowered.

The internal stirring blade unit 1 of the present invention may be a flat turbine blade unit, a pitched turbine blade unit, a concave blade unit, a cylindrical blade unit, etc., if it is a discharge type one.

The perforated cylinder 2 used for the entire stirring blade unit 5 of the present invention should have a numerical aperture of 35 to 45%, i.e., perforations P make up 35 to 45% of the area of the sidewall of the perforated cylinder. The structure should be a punched metal or mesh cylindrical body. The height L and diameter r of the perforated cylinder 2 should be 1.5 to 3 times the width b of the blade 3 of the internal stirring blade unit 1 and 1.01 to 1.05 times the diameter of the internal stirring blade unit 1. The material of the perforated cylinder 2 may be ceramic, stainless steel, iron, etc. if it has enough strength for use.

The internal stirring blade unit 1 and the perforated cylinder 2 can be attached, as follows: the perforated cylinder 2 is welded or bolted to the tip of the internal stirring blade unit 1 or the lug of the perforated cylinder 2 is attached to the disc 8 of the internal stirring blade unit 1 to fix the perforated cylinder 2, for example. In addition, the perforated cylinder 2 should be positioned so that the blade 3 of the internal stirring blade unit 1 comes into the center of the perforated cylinder 2.

Furthermore, in the present invention, such a gas as air may be ventilated by a single-hole nozzle, a multi-hole nozzle, a sparger, etc., any of which are represented by reference numeral 6, provided just under the entire stirring blade unit 5 of the present invention. The aeration method is not limited specially.

Thus, the entire stirring blade unit 5 of the present invention can refine bubbles more and accordingly, improve the gas absorption efficiency in a gas-liquid mixing tank (for hydrogenation, etc.) more than the prior art stirring blade units.

EXAMPLES

Hereunder, the present invention will be explained in more detail below with reference to the examples, i.e., Example 1, Example 2, and Usage Example 1.

Example 1

The first example of the present invention will be explained with reference to FIG. 2.

Figure 2:
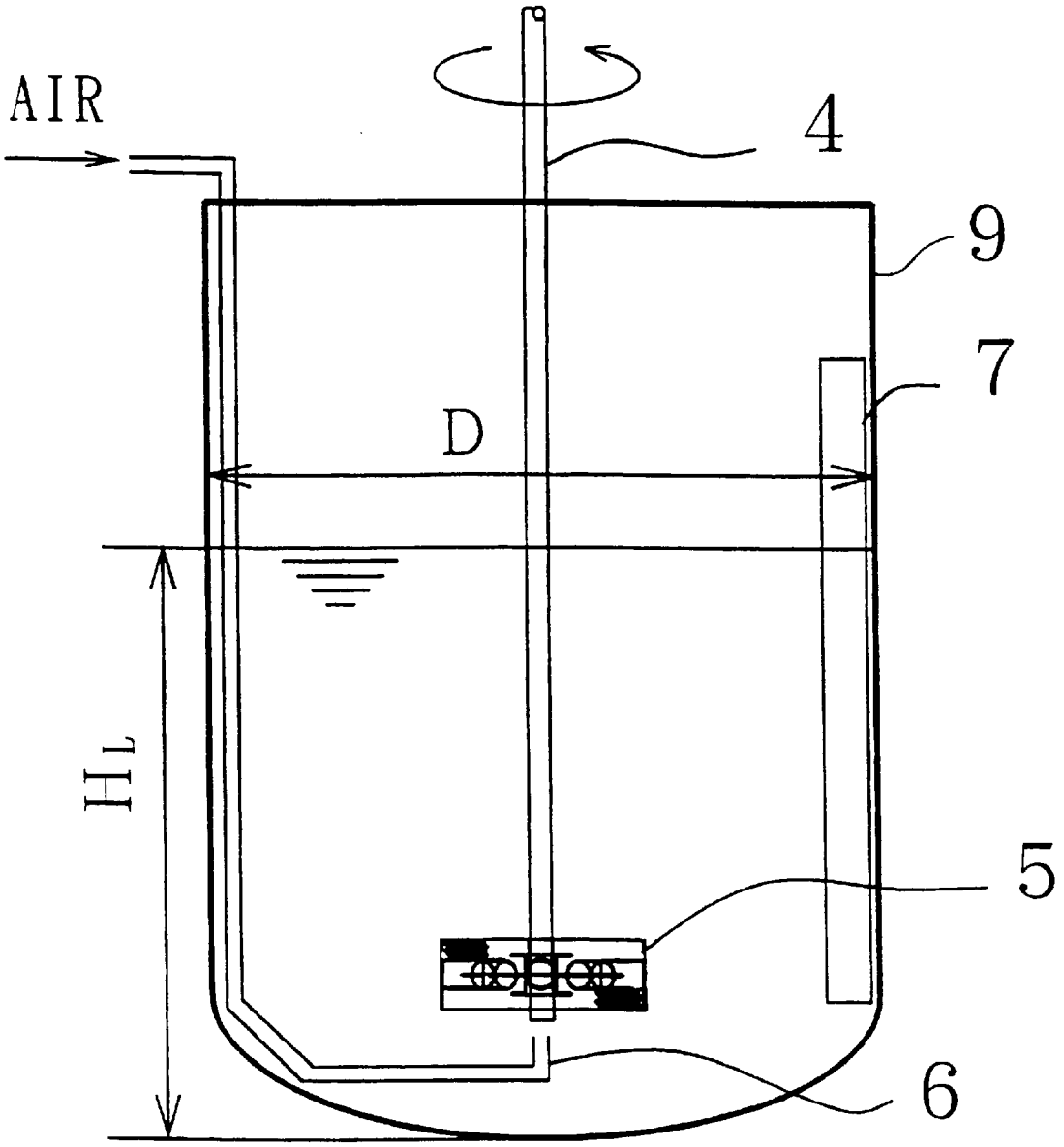
FIG. 2 is a cross-sectional view showing the use of the entire stirring blade unit 5 of the present invention, shown in FIGS. 1(*a*) and 1(*b*), in a stirring tank 9 in the first example.

FIG. 2 is a cross-sectional view of the entire stirring blade unit 5 used for a measurement. The stirring tank 9 is a cylindrical stirring tank provided with a 70 L transparent acrylic lid. The bottom of the tank 9 is mirror-processed (10% end shape). In addition, eight 30-mm wide baffles 7 are attached symmetrically on the wall of the tank. The liquid depth HL is decided as HL/D=1 (D=400 mm) to the diameter of the tank 9. Then, the effect of the present invention was checked by measuring the oxygen transfer rate OTR (generic name of oxygen transfer rate: OTR Kla) of the entire stirring blade unit 5 in the above stirring tank 9 using the sulfite oxidation method. The entire stirring blade unit 5 of the present invention was put just above the sparger nozzle 6 provided near the bottom of the tank 9 and a gas was supplied from the nozzle 6 as a rate of 0.85 VVM (gas volume/charge liquid volume per min) for the above measurement. In this case, 8-turbine blades and cylindrical blades 3 (diameter d=110 mm, width b=21 mm of each blade 3 commonly) are used for the internal blade unit 1 of the present invention. As the perforated cylinder 2, a punched metal (diameter r=115 mm, height h=50 mm, numerical aperture=38%, hole diameter=2 mm) was used. As shown in Table 1, when the entire stirring blade unit 5 of the present invention was used, the oxygen transfer rate OTR was improved by 26% in maximum at the same stirring power (Pv=1 kW/m$^3$) when compared with the prior art 8-turbine-blade unit used generally for gas-liquid mixing or the "EGSTAR" (product name of EBLE (Inc.)). The 8-turbine-blade unit used in this test was a stirring blade one (blade diameter d=110 mm, width b=21 mm, cylinder height L=200 mm) comprising a pair of propeller blades and a perforated cylinder that were rotated together to improve the efficiency of stirring mixture (described in Examined Published Japanese Patent Application No. 6-85862).

TABLE 1

Comparison of Oxygen Transfer Rates among Stirring Blade Units

| Stirring Blade Unit | Oxygen Transfer Rate OTR [mol/m$^3$ · hr] | OTR Difference [–] |
|---|---|---|
| 8-turbine-blade unit | 116.4 | 1 |
| "EGSTAR" | 87.5 | 0.75 |
| Present invention internal blade unit: 8-turbine-blade unit | 130.9 | 1.13 |
| Present invention internal blade unit: Cylindrical blade unit | 146.9 | 1.26 |

*The OTR difference indicates the value of each stirring blade unit when the 8-turbine-blade unit OTR is assumed to be 1.

Then, the oxygen transfer rate OTR change was measured by changing the numerical aperture of the perforated cylinder used in the stirring blade unit of the present invention explained above under the same conditions as the above. Table 2 shows measurement results when the numerical aperture of the perforated cylinder is changed to 0, 30, 35, 44, 50, and 55% respectively. The OTR value in Table 2 is a value when the stirring power is 1 kW/m$^3$ . When the numerical aperture is 30 to 50% in Table 2, it is found that the oxygen transfer rate is higher than that of the 8-turbine-blade unit. When the numerical aperture is larger, the discharge flow passes through the perforated cylinder more easily. So, the pressure change to be generated both inside and outside the perforated cylinder becomes smaller. In addition, when the numerical aperture is smaller, the resistance of the flow becomes large excessively due to the function of the perforated cylinder. Thus, the discharge flow cannot pass through the perforated cylinder.

TABLE 2

Difference of Oxygen Transfer Rate OTR by Numerical Aperture Change

| Stirring Blade Unit | Numerical Aperture [%] | Oxygen Transfer Rate OTR [mol/m$^3$ · hr] | OTR Difference [–] |
|---|---|---|---|
| 8-turbine-blade unit | — | 116.4 | 1 |
| Present | 0 | 97.5 | 0.84 |
| inventions | 30 | 117.2 | 1.01 |
| internal | 35 | 146.9 | 1.26 |
| stirring blade | 44 | 132.5 | 1.14 |
| unit: Cylindrical | 50 | 122.4 | 1.05 |
| blade unit | 55 | 115.3 | 0.99 |

*The OTR difference indicates the value of each stirring blade unit when the 8-turbine-blade unit OTR is assumed to be 1.

Example 2

The stirring blade unit of the present invention was attached in a 2.5 m$^3$ fermentation tank and the oxygen transfer rate OTR was measured using the sulfite oxidation method. The stirring conditions were as follows; the liquid volume was 1.5 m$^3$, the aeration volume was ⅓ VVM, the temperature was 30 C. The sparger nozzle provided just under the stirring blade unit was used for aeration just like in the first embodiment. In this case, a cylindrical blade unit (blade diameter d=500 mm, width b=80 mm) was used as the internal stirring blade unit and a punching metal (diameter r=510 mm, height h=190 mm, numerical aperture=40%, and hole diameter=5 mm) was used as the perforated cylinder. In a comparison test, an 8-turbine-blade unit (blade diameter d=500 mm, width b=80 mm) was used instead of the stirring blade one of the present invention. The test conditions were the same as those of the above test.

As a result of the measurement performed under the above conditions, the oxygen transfer rate OTR was improved by about 25% to 107.7 mol/m$^3$, although it was 86.4 mol/m$^3$.hr for the 8-turbine blade unit under a stirring power of 1 kW/m$^3$.

Usage Example 1

The stirring blade unit of the present invention was attached in a 2.5 m$^3$ fermentation tank and L-glutamic acid was fermented as follows using brevibacterium flavum QBS-4 FERM P-2308 described in Examined Published Japanese patent Application No.52-024593.

At first, the culture medium comprising the components as shown in Table 3 was adjusted and it was transferred into a 500 ml flask in units of 20 ml and heated at 115° C. for 10 min for sterilization. Then, it was seed-cultured.

TABLE 3

Seed Culture Medium

| Component | Concentration |
|---|---|
| Glucose | 50 g/l |
| Urea | 4 g/l |

TABLE 3-continued

Seed Culture Medium

| Component | Concentration |
|---|---|
| $KH_2PO_4$ | 1 g/l |
| $MgSO_4 \cdot 7H_2O$ | 0.4 g/l |
| $FeSO_4 \cdot 7H_2O$ | 10 g/l |
| $MnSO_4 \cdot 4H_2O$ | 10 g/l |
| Thiamine hydrochloride | 200 g/l |
| Biotin | 30 g/l |
| Soybean protein hydrolytic substance (as the whole ferment volume) (pH 7.0) | 0.9 g/l |

Subsequently, the main culture medium shown in Table 4 was adjusted and sterilized at 115 C. for 10 min. After this, a seed culture medium liquid was inoculated and main-cultured at 31.5 C. in a 2.5 m$^3$ fermentation tank. In this case, the stirring conditions were as follows; the rotation speed was 175 rpm and the aeration volume was ½ VVM. For the aeration, a sparger nozzle provided just under the stirring blade unit was used just like in the example 1. As the stirring blade unit for culturing, an 8-turbine-blde unit (blade diameter d=500 mm, width b=80 mm) and the stirring blade unit of the present invention were used for culturing respectively. As the internal stirring blade unit of the present invention, a cylindrical blade unit (blade diameter d=500 mm, width b=80 mm) was used. As the perforated cylinder, a punching metal (diameter r=510 mm, height h=190 mm, numerical aperture=40%, hole diameter=5 mm) was used. During the culturing culture medium pH was adjusted to 7.8 with an ammonia gas. When the succharum in the culturing liquid was consumed up, the fermentation was ended and the L-glutamic acid accumulated in the culturing liquid was measured. Table 5 shows the culturing result.

As a result, when the stirring blade unit of the present invention was used, the oxygen transfer rate was improved, so that the L-glutamine acid generation rate was improved by about 25% to 3.14 g/l/hr from 2.51 g/l/hr as shown in Table 5.

TABLE 4

Main Culture Medium

| Component | Concentration |
|---|---|
| Waste syrup (as glucose) | 150 g/l |
| $KH_2PO_4$ | 1 g/l |
| $MgSO_4 \cdot 7H_2O$ | 1 g/l |
| Thiamine hydrochloride | 100 g/l |
| Anti-foaming agent (pH 7.0) | 20 μl/l |

TABLE 5

Culturing Result

| Stirring Blade Unit | L-glutamic acid accumulated volume (g/l) | L-glutamic acid generation speed (g/l/hr) |
|---|---|---|
| 8-turbine-blade unit | 75.2 | 2.51 |
| Present invention's blade unit | 76.1 | 3.14 |

Industrial Applicability

The discharge type stirring blade unit of the present invention is characterized by a perforated cylinder rotated together with the stirring shaft around the blade unit and having a numerical aperture of 30 to 50%. The blade unit thus allows the gas-liquid flow discharged from the blade unit to hit the perforated cylinder, changing the pressure of the gas-liquid flow significantly. As a result, the gas bubbles can be refined efficiently to improve the efficiency of gas absorption in the gas-liquid mixing tank, as well as improve the energy-saving effect.

Furthermore, when improving an existing stirring tank that uses a discharge type blade unit such as a turbine blade one, it is only needed to replace the stirring blade unit with the blade unit of the present invention to improve the performance. No other significant modification such as replacement of the motor and reducer, reinforcement of the fermentation tank is required. Because, the power characteristics are not different so much between the existing blade unit and the blade unit of the present invention.

The stirring blade unit of the present invention will be useful for a fermentation tank, an aeration tank, a reaction tank (hydrogenation and oxidation), etc.

What is claimed is:

1. A stirring blade unit comprising:

a rotatable shaft;

a disc for preventing gas bubbles from going up through a top of said stirring blade unit, wherein said disc is fixedly attached to and rotates with said rotatable shaft;

a plurality of blades for gas-liquid mixing, wherein each of said plurality of blades has a first end which is fixedly attached to said disc at an end of said disc which is opposite of where said disc is fixedly attached to said rotatable shaft;

a perforated cylinder rotating together with said rotatable shaft by way of said perforated cylinder being formed around said plurality of blades attached to said disc and a second end of each of said plurality of blades being fixedly attached to an inner surface of a sidewall of said perforated cylinder at an approximately central portion of said perforated cylinder, wherein said perforated cylinder has perforations in said sidewall thereof, said perforations making up approximately 30 to 50% of an area of said sidewall of said perforated cylinder.

2. The stirring blade unit according to claim 1, wherein each of said plurality of blades is selected from a group consisting of a flat turbine blade, a pitched turbine blade, a concave blade, and a cylindrical blade.

3. The stirring blade unit according to claim 1, wherein said perforated cylinder comprises a body selected from a group consisting of a punched metal cylindrical body and a mesh cylindrical body.

4. The stirring blade unit according to claim 1, wherein said perforated cylinder has a height, which is 1.5 to 3 times a width of each of said plurality of blades, and an outer diameter, which is 1.01 to 1.05 times a diameter measured from a tip of a first blade of said plurality of blades to a tip of a second blade of said plurality of blades where said first blade and said second blade are each attached to said disc so as to symmetrically oppose each other across a diameter of said disc.

5. A stirring blade unit comprising:

a discharge-type blade for gas-liquid mixing;

a stirring shaft on which said discharge-type blade is mounted; and a perforated cylinder rotating together with said stirring shaft, wherein said perforated cylinder is attached to said discharge type blade, wherein said perforated cylinder is open at a top and bottom thereof, and wherein said perforated cylinder has perforations in a sidewall thereof so that said perforations make up approximately 30 to 50% of an area of said sidewall of said perforated cylinder.

6. The stirring blade unit according to claim 5, wherein said discharge-type blade is selected from a group consisting of a flat turbine blade, a pitched turbine blade, a concave blade, and a cylindrical blade.

7. The stirring blade unit according to claim 5, wherein said perforated cylinder comprises a body selected from a group consisting of a punched metal cylindrical body and a mesh cylindrical body.

8. The stirring blade unit according to claim 5, wherein said perforated cylinder has a height which is 1.5 to 3 times a width of said discharge-type blade and a diameter which is 1.01 to 1.05 times a diameter of said discharge-type blade.

* * * * *

UNITED STATES PATENT AND TRADEMARK OFFICE

CERTIFICATE OF CORRECTION

PATENT NO. : 6,328,466 B1
DATED : December 11, 2001
INVENTOR(S) : Kadota et al.

It is certified that error appears in the above-identified patent and that said Letters Patent is hereby corrected as shown below:

Title page,
Item [86], the PCT information should read:

| | | |
|---|---|---|
| [86] | PCT No.: | PCT/JP98/00106 |
| | § 371 Date" | Aug. 31, 1999 |
| | § 102(e) Date: | Aug. 31, 1999 |

Signed and Sealed this

Eighteenth Day of June, 2002

*Attest:*

*Attesting Officer*

JAMES E. ROGAN
*Director of the United States Patent and Trademark Office*